US005239710A

United States Patent [19]

Swinburn

[11] Patent Number: 5,239,710

[45] Date of Patent: Aug. 31, 1993

[54] SPA POOL

[75] Inventor: Jack Swinburn, 2 Paringa Avenue, Somerton Park, SA 5044, Australia

[73] Assignees: Jack Swinburn; Enid Mary Elizabeth Swinburn, Australia

[21] Appl. No.: 752,474

[22] PCT Filed: Feb. 23, 1990

[86] PCT No.: PCT/AU90/00073

§ 371 Date: Sep. 23, 1991

§ 102(e) Date: Sep. 23, 1991

[87] PCT Pub. No.: WO90/10131

PCT Pub. Date: Sep. 7, 1990

[30] Foreign Application Priority Data

Feb. 24, 1989 [AU] Australia ..... PJ2920

[51] Int. Cl.[5] ..... E04H 4/14

[52] U.S. Cl. ..... 4/506

[58] Field of Search ..... 4/488, 492, 493, 494, 4/496, 498, 499, 500, 503, 506, 641.1, 541.2, 541.3, 541.4, 541.5, 541.6; 52/169.7, 169.8, 742

[56] References Cited

U.S. PATENT DOCUMENTS

| | | | |
|---|---|---|---|
| 3,429,085 | 2/1969 | Stillman, Jr. | 52/169.7 |
| 3,488,782 | 1/1970 | Billig et al. | 4/506 |
| 3,644,941 | 2/1972 | Kuss | 52/169.7 |
| 3,801,994 | 4/1974 | Brown | 4/499 |
| 3,816,234 | 6/1974 | Winfield | 4/506 X |
| 3,918,221 | 11/1975 | Benjamin | 4/499 X |
| 4,109,325 | 8/1978 | Shuff | 4/503 X |
| 4,152,791 | 5/1979 | Rose | 4/493 X |
| 4,281,422 | 8/1981 | Simonelli | 4/496 |
| 4,457,119 | 7/1984 | Dahowski | 4/499 X |
| 4,561,134 | 12/1985 | Mathews et al. | 4/496 |

FOREIGN PATENT DOCUMENTS

| | | | |
|---|---|---|---|
| 1434699 | 1/1969 | Fed. Rep. of Germany . | |
| 1938472 | 10/1970 | Fed. Rep. of Germany . | |
| 2004656 | 8/1971 | Fed. Rep. of Germany | 4/498 |
| 2934074 | 3/1980 | Fed. Rep. of Germany . | |

*Primary Examiner*—William A. Cuchlinski, Jr.
*Assistant Examiner*—W. Morris Worth
*Attorney, Agent, or Firm*—Lyman R. Lyon

[57] ABSTRACT

The spa pool (1) is constructed with a solid base and side walls (4), the spa pool having a soft interior. The water is contained in a vinyl liner (5), and between the liner (5) and the base and/or the side walls (4) there is positioned a layer of resilient material such as foam plastic material, or foam rubber.

8 Claims, 5 Drawing Sheets

SPA POOL

This invention relates to an improved spa pool which can be easily and readily constructed for domestic use, and also which offers greater comfort to the user.

BACKGROUND OF THE INVENTION

Many people are enthusiastic about the benefits to be gained by the use of a spa. The relaxing effect of water and air surging over the body surfaces, has a very relaxing effect, and many people with back problems testify to the relief they obtain after spending some time in a heated spa.

Almost invariably there is mention of a side effect, i.e. the subsequent discomfort experienced from spending extended periods spent lying or sitting on or against the hard surfaces of the spa vessel itself.

Spas are usually constructed of concrete, with or without internal tiling, fiberglass, plastics materials such as acrylic resins, timber, and the like.

Thus it is an object of the invention to provide a spa which has a soft interior for greater comfort to the user.

It is a further object of the invention to provide a spa with a plastic membrane lining which has a cushioning substance between the plastic membrane and the actual structure of the spa including the floor of the spa.

In a preferred form of the invention the cushioning substance can be a foam material similar to that used for upholstery in household and office furniture. In most cases this material is multi-cellular, similar to plastic sponges, but it is preferable to use a uni-cellular material, e.g., a material which has individual air cells unconnected one to the other.

Thus the invention provides an interior surface which is comfortable to lie or sit in with none of the discomforts which may prevail with a hard interior.

Also it is an object of the invention to provide an insulated spa to thus minimise heating costs in the operation of the spa.

BRIEF STATEMENT OF THE INVENTION

Thus there is provided according to the invention a spa in which the body of the spa is constructed of a solid material, the water in the spa being retained by a liner or membrane, characterised in that there is provided between the liner and the solid material a resilient material selected from foam plastic material or foam rubber so that the spa has a soft interior for greater comfort of the user.

Preferably the body of the spa itself can be constructed of metal which is suitable treated to withstand any corrosion should it be installed in the ground. Alternatively other materials such as fiberglass, acrylic resins or timber may be used. No floor structure is required because the lining of the spa will rest on the foam padding which is placed on the floor during assembly.

In all cases there preferably will be a locking system fitted to the wall to hold the membrane in place. This should also provide for simple removal of the lining in the event of a damage being experienced to the lining requiring the liner to be replaced.

It is preferred that the fittings such as spa jets, suction points, and skimmer unit which are installed in the spa wall be designed to enable the lining to be replaced without having to disturb the main fittings themselves which will obviate the necessity of having to disturb the pipework on the exterior of the spa wall.

BRIEF DESCRIPTION OF THE INVENTION

In order to more fully describe the invention reference will now be made to the accompanying drawings in which:

FIG. 1 is a cross sectional view of a free sanding spa according to the invention, FIG. 2 is a cross sectional view of an in-ground spa, FIG. 3 shows diagrammatically one form of the invention, FIG. 4 shows a further form of the invention, FIG. 5 shows an example of locating the liner and foam in position in corners in modifying existing spas, FIG. 6 shows an example of the attachment of spa jet fittings to the wall of the spa, FIG. 7 shows an inflated cover for an out door spa, FIG. 8 shows the cover deflated to provide insulation to the spa when not in use, FIG. 9 shows in cross section a seat which may be provided for use in the spa, and FIG. 10 is a plan of one form of such a seat.

DESCRIPTION OF THE PREFERRED EMBODIMENT

Figure 1:
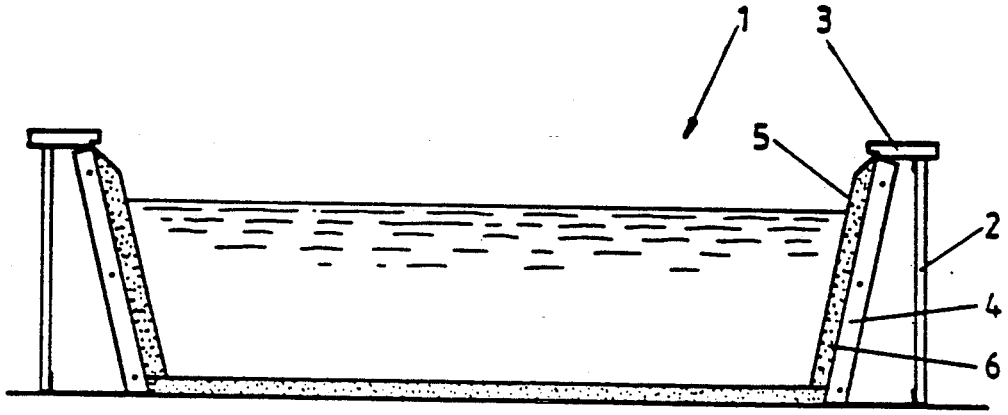

Referring firstly to FIG. 1 of the drawings there is shown a free standing spa 1 having an outer wall 2 in suitable decor material, such as timber, and a spa coping 3 which also may be of timber, or fiber glass, extruded plastics material or other suitable material. For indoor spas this can also be an upholstered finish similar to a household chair. There is provided a spa wall 4 extending from ground level to the top of the coping 3 the wall 4 being either inclined as shown or vertical. The water is retained by a liner 5, this preferably being a plastic membrane, such as P.V.C., the liner being anchored to the coping 3. Between the liner and the spa walls 4 and the ground on which the spa rests there is provided a layer of soft resilient material, such as foam plastic foam rubber or the like.

Figure 2:
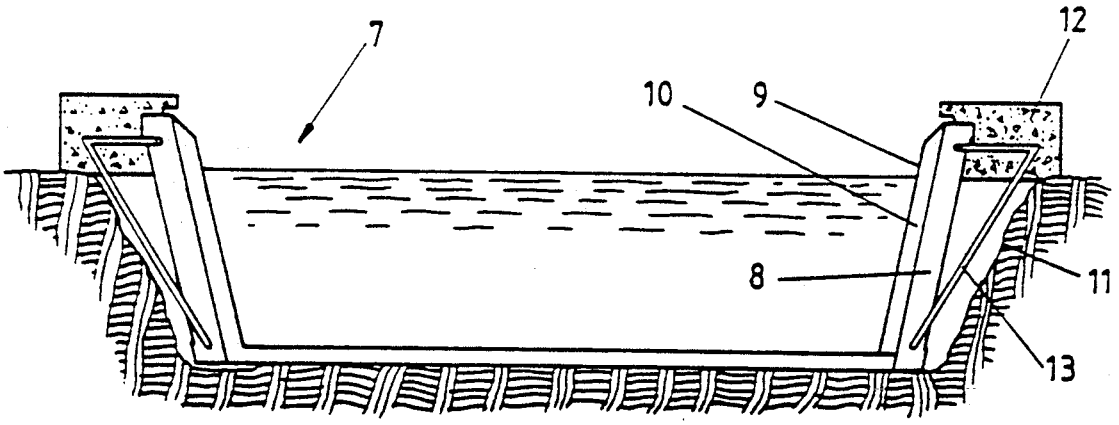

In FIG. 2 here is shown an example of an in-ground spa 7 having spa walls 8, liner 9 and resilient material 10. The spa is erected in an excavation 11, the excavation 11 is lined with a plastic membrane prior to the spa being assembled and the resilient material 10 is positioned on the plastic membrane. A reinforced concrete beam 12 surrounds the spa, with the liner being locked into an aluminium or plastic extrusion fitted to the top of the wall in all cases. The reinforcing rods in the beam are wired to the cantilever side brackets 13.

It will be realised that the spa, whether of the free standing type or of the in-ground type can be made in various configurations in plan, for example, square, rectangular, hexagonal, or in effect any polygon, as long as it is possible to construct the liner to fit the shape for it is only necessary for the liner to be continuous, for the walls and the resilient material between the walls and the liner can each be made in various sections to be assembled on site.

Figure 3:
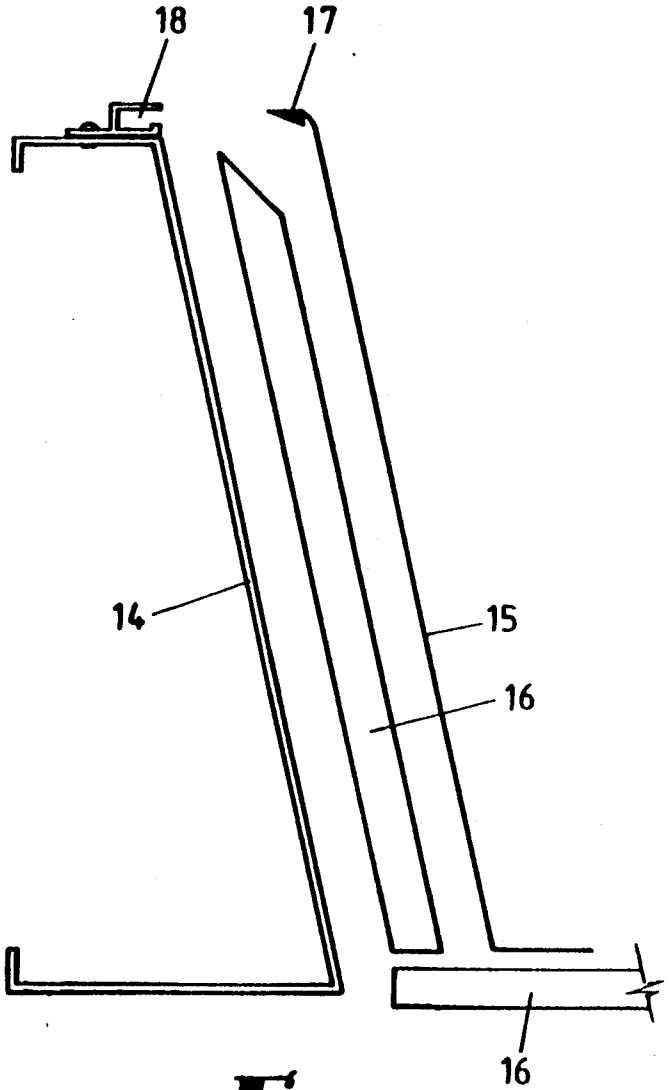

As shown in FIG. 3, the resilient material 16 is positioned adjacent the spa wall 14 and then the liner 15 is positioned and locked with an arrow head like bead 17 into the locking channel 18, in this instance on the upper edge of the wall 14. Alternatively the locking channel 18 can be on the coping, or fitted to the concrete beam of an in-ground spa.

Figure 4:
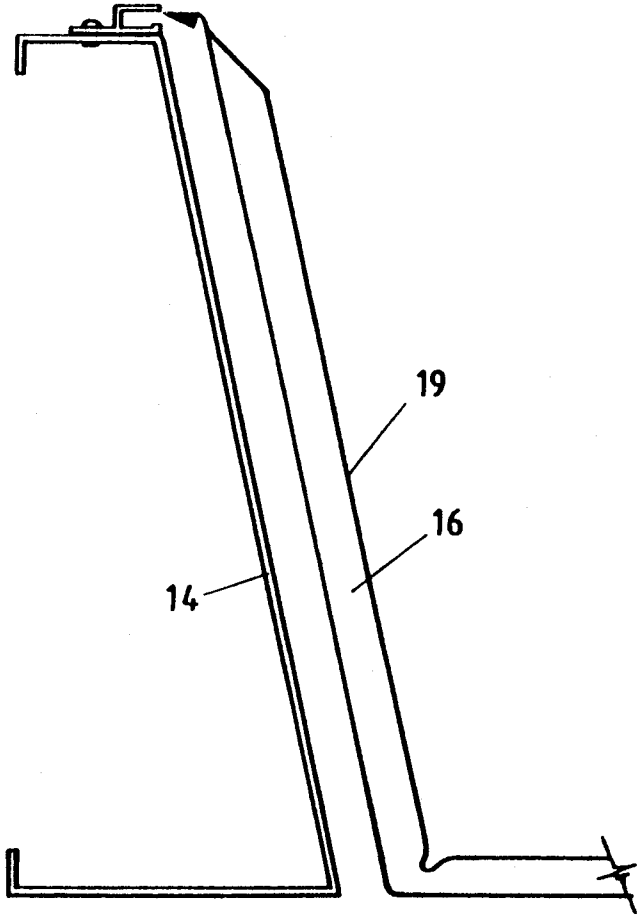

An alternative construction is shown in FIG. 4 in which the resilient material 16 such as foam plastic is encased in a double lining 19.

Figure 5:
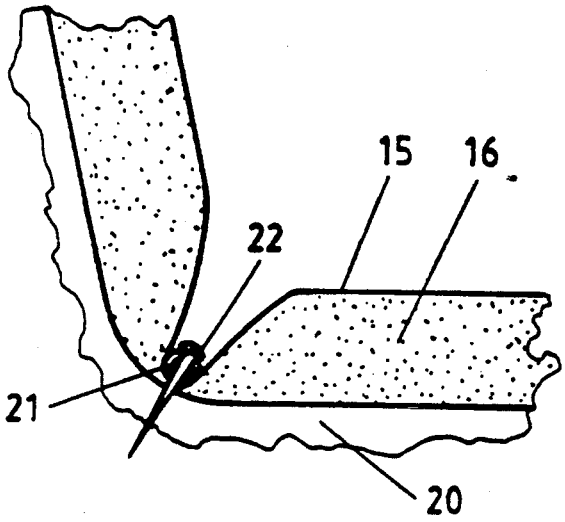

In order to locate the lining in acute corners, such as at the junction of the walls to the floor, and at the acute angles formed by seats or the like in the spa, reference can be made to FIG. 5 where the liner 15 and the foam plastic material 16 are located in the corner of a seat 20 by a stainless steel tube 21 laid in the corner and located and fixed in position by a fixing nail or screw.

If it is desired to provide a soft interior to existing spas, then instead of having a liner with a locking bead to engage in a locking channel, the liner may be attached by the use of a stainless steel strip passing around the edge of the liner, which steel strip is screwed to the wall of the spa, the liner of course having between itself and the walls of the spa the foam plastic material.

Figure 6:
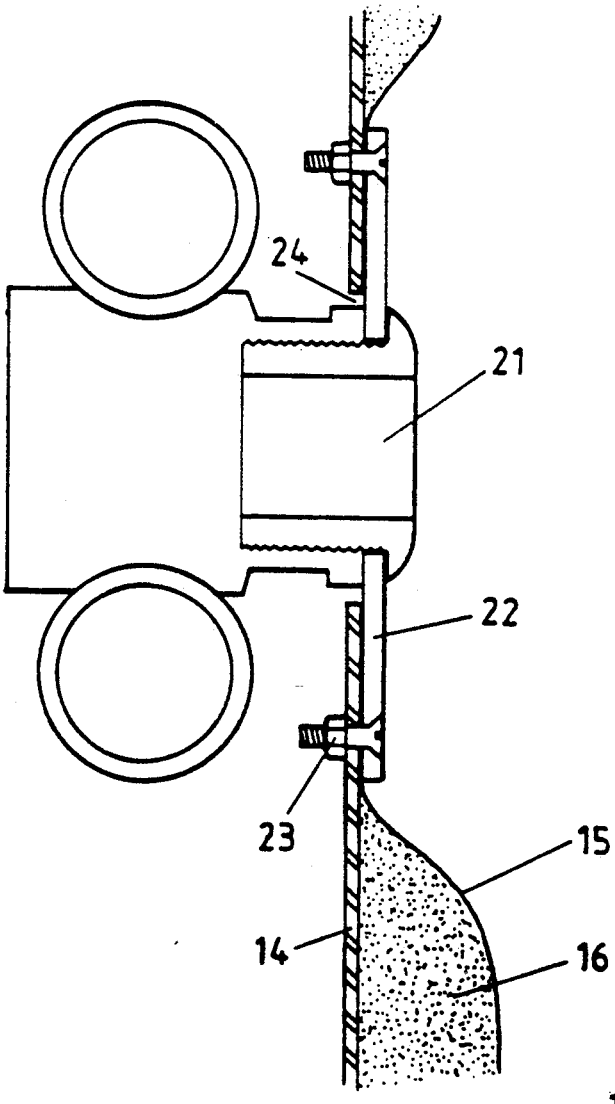

FIG. 6 shows an example of the fitting of a spa jet to the wall of the spa in such a way that the spa jet may be removed without disturbing the seal of the liner to the wall of the spa. The standard spa jet 21 suitable for the delivery of air and water is removably mounted in a flange 22, preferably of plastics material, which flange is then affixed as by bolts 23 to the wall 14. It is noted however that the flange 22 covers and the bolts 23 pass through both the liner and the foam plastics material, thus compressing the foam plastics material between the liner and wall thus making a seal around the opening 24 in the wall of the spa. Thus to remove the spa jet it is not necessary to disturb the flange, for the spa jet can be removed from the flange itself.

As many spas are located out of doors, and as spas use hot water there is in a spa a great deal of heat loss. The soft foam material of the present invention acts as a very efficient insulator on the walls and the floor, and thus maximum heat loss will occur at the surface of the water by both radiation and the cooling effect by evaporation.

One of the more costly aspects of operating a spa, especially when it is situated out doors is the heating operation. These heat losses can be considerably reduced if the surface of the spa is covered with an insulating material, and in accordance with an aspect of the invention here is provided a cover for the surface of the spa comprising a double layer of sheet material with an insert of material similar to the material used for the padding of the floor and walls of the spa.

Figure 7:
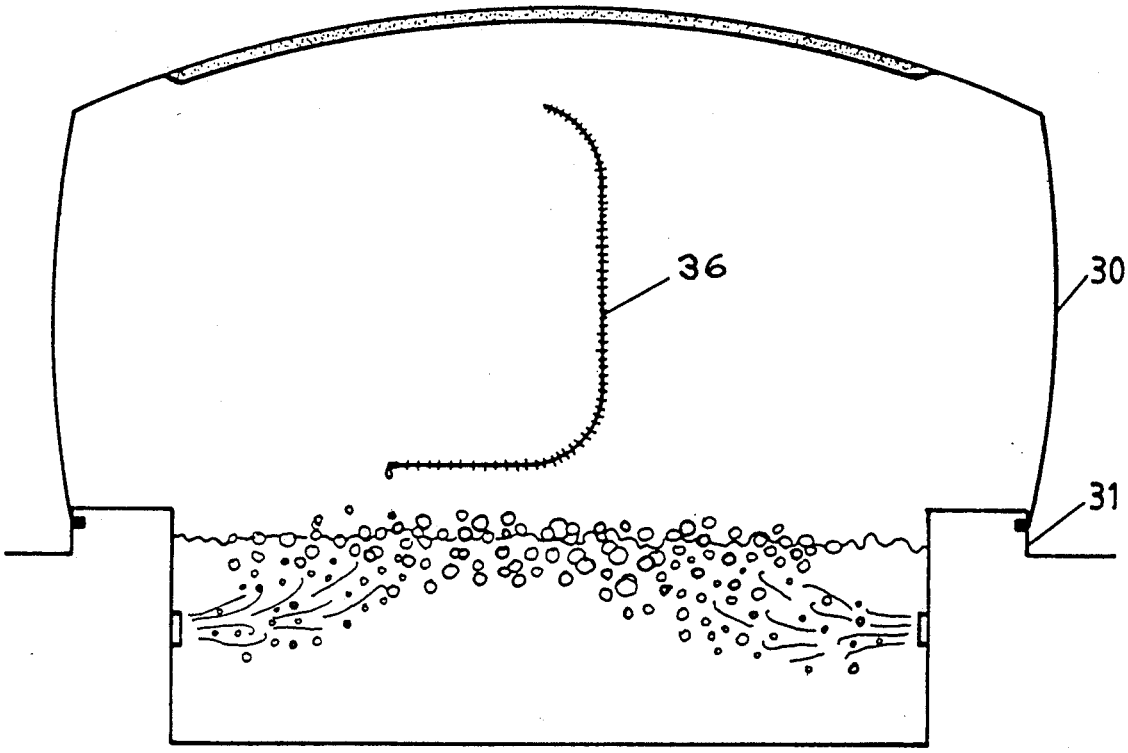
Figure 8:
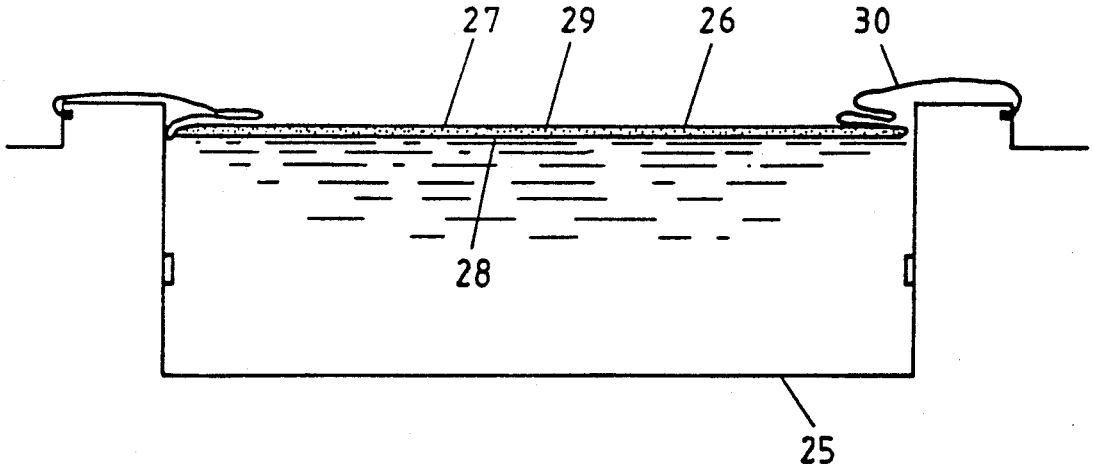

Thus as shown in FIG. 7 and FIG. 8 a spa 25 having a cover 26 covering the surface of the water as inn FIG. 8, the cover 26 comprising plastic sheets 27 and 28 with insulating material 29 sandwiched therebetween. To the outer perimeter of the cover 26 there is attached a skirt 30 and whose outer edge is attached to the coping or outer concrete beam of the spa. One portion of the skirt is provided with a zip fastener on a fold back flap to allow entry into the spa.

When the spa filtration and blower equipment is switched on the air will inflate the cover to form an airhouse resulting in a totally enclosed area. Ingress to the spa is provided by means of a heavy duty zip fastener. The result is a spa which is out doors, insulated at bottom, sides and top to retain heat from the previous usage. This minimises heating costs and also enables the spa to be used in comfort during inclement weather by means of the insulated air house that erects itself by means of the spa air blower. Air drawn in by the venturi effect is still sufficient to erect the air house even if the air blower is not used. Pockets for dressing gowns, towels and other garments may be fitted to the inside of the air house wall. It is noted that this system can be used for swimming pools provided that a blower is provided for air house erections.

In most cases a safety valve would be necessary. Even a very low pressure adds up to a high loading when the total area is taken into consideration, and hence a safety flap valve would be installed.

When the spa is switched off, the air house cover will gradually sink back on to the surface of the water, thus minimising the heat losses and thereby providing a considerable economy in the heating costs.

Figure 9:
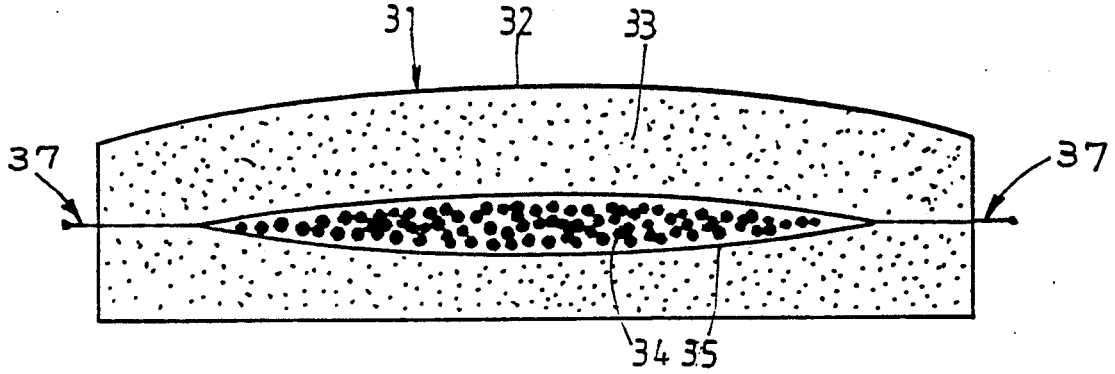
Figure 10:
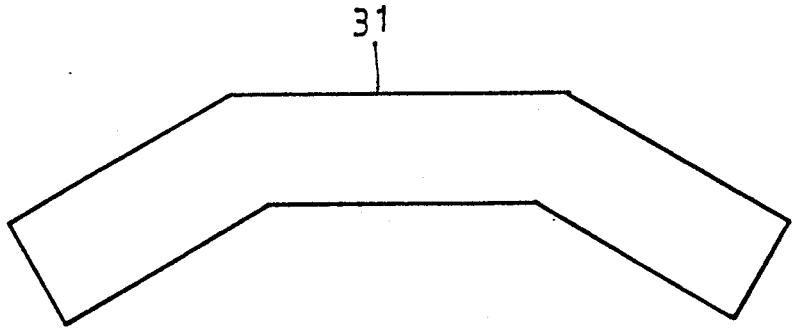

Referring now to FIGS. 9 and 10 of the drawings, there is shown a seat 31 which can be positioned in the spa and removed and repositioned as desired. The seat 31 has a waterproof outer cover 32, this preferably being a vinyl material. The seat is filled with a foam type of material 33 which can be foam plastic, foam rubber or even foam balls or beans. In order ensure the seat will remain on the floor of the spa, there is included in the seat a layer or bag of heavy material to form a ballast 34. This ballast can be lead shot or the like and is preferably contained in a bag 35, and for convenience in handling, the bag edges can extend through the side wall of the seat to provide handles for the lifting of the seat.

In an alternate form of the invention the seat can be made in two separate portions, an upper portion and a lower portion, and before the two portions are joined together a quantity of lead shot is placed between the two portions, the two portions then being sealed together in a watertight manner to form the seat with a ballast to hold it in the bottom of the spa.

As shown in FIG. 10 the seat in plan view can have various shapes, and as illustrated the seat can be in three portions joined together to fit three sides of an octagonal spa. However the seat may be rectangular or even circular or any other shape as desired Thus it will be seen that there is provided according to the invention a spa which provides a cushioned interior thereby providing for the comfort of the user. Also the invention provides a spa which is insulated to provide economies in the heating costs, and also provides a cover to insulate the surface of the water and which also provides an enclosed area above the pool to protect the user from the weather.

I claim:

1. A spa pool comprising:

a support structure having a base and at least one side wall;

a liner or membrane connected to an upper edge of the support structure to retain water therein;

a relatively soft and resilient material selected from a foam plastics material or foam rubber interjacent the liner and the support structure to provide a soft interior for greater comfort of a person using the spa pool, wherein the resilient material is in the form of a sheet and is positioned and held in place relative to the support structure by the liner; and further comprising a plurality of fittings positioned in the at least one wall of the support structure, each of the plurality of fittings being releasably attached to a flange, said flange being fixedly attached to the at least one wall with the liner and resilient material being compressed under the flange to form a seal between the flange and the at least one wall.

2. The spa pool of claim 1 wherein the spa pool is situated out-doors and is provided with an insulated cover to retain heat in the water when the spa pool is not in use.

3. The spa pool of claim 2 wherein the insulated cover is provided with a surrounding skirt attached to an edge or coping surround of the support structure so that on the application of air pressure beneath the cover and skirt, the cover and skirt are inflated to form an enclosure over the surface of the water in the spa pool.

4. The spa pool of claim 3 wherein the plurality of fittings include spa jets and the skirt has at least one reclosable opening to permit entry within the inflated enclosure, the enclosure being inflated by the flow of air through the spa jets.

5. A spa pool comprising:

an exterior support structure having a base and at least one side wall;

a first liner or membrane layer adjacent an inside surface of the support structure;

a relatively soft and resilient material selected from a foam plastics material or foam rubber adjacent the first liner or membrane layer;

a second liner or membrane layer adjacent the resilient material, said first and second liner or membrane layers being arranged to totally enclose the resilient material in a sandwich construction which is connected to an upper edge of the support structure to retain water therein, wherein the resilient material provides a soft interior for greater comfort of a person using the spa pool; and further comprising a plurality of fittings positioned in the at least one wall of the support structure, each of the plurality of fittings being releasably attached to a flange, said flange being fixedly attached to the at least one wall with the first and second liner layers and the interjacent resilient material being compressed under the flange to form a seal between the flange and the at least one wall.

6. The spa pool of claim 5 wherein the spa pool is situated out-doors and is provided with an insulated cover to retain heat in the water when the spa pool is not in use.

7. The spa pool of claim 6 wherein the insulated cover is provided with a surrounding skirt attached to an edge or coping surround of the support structure so that on the application of air pressure beneath the cover and skirt, the cover and skirt are inflated to form an enclosure over the surface of the water in the spa pool.

8. The spa pool of claim 7 wherein the plurality of fittings include spa jets and the skirt has at least one reclosable opening to permit entry within the inflated enclosure, the enclosure being inflated by the flow of air through the spa jets.

* * * * *